US006811676B2

(12) United States Patent
Bradford et al.

(10) Patent No.: US 6,811,676 B2
(45) Date of Patent: Nov. 2, 2004

(54) ELECTROLYTIC CELL FOR PRODUCTION OF ALUMINUM FROM ALUMINA

(75) Inventors: Donald R Bradford, Underwood, WA (US); Robert J. Barnett, Goldendale, WA (US); Michael B. Mezner, Sandy, OR (US)

(73) Assignee: Northwest Aluminum Technologies, Seattle, WA (US)

( * ) Notice: Subject to any disclaimer, the term of this patent is extended or adjusted under 35 U.S.C. 154(b) by 199 days.

(21) Appl. No.: 10/195,733

(22) Filed: Jul. 16, 2002

(65) Prior Publication Data

US 2004/0011660 A1 Jan. 22, 2004

(51) Int. Cl.[7] ..... C25C 3/08; C25C 3/12; C25C 3/06; C25C 3/00

(52) U.S. Cl. ..... 205/380; 205/376; 205/386; 205/387; 205/394; 205/396; 204/244; 204/245; 204/247

(58) Field of Search ..... 205/376, 380, 205/385, 386, 387, 394, 396; 204/244, 245, 247

(56) References Cited

U.S. PATENT DOCUMENTS

| | | | | |
|---|---|---|---|---|
| 3,578,580 A | | 5/1971 | Schimdt-Hatting et al. | 204/243 |
| 3,960,678 A | | 6/1976 | Alder | 204/67 |
| 4,110,178 A | | 8/1978 | LaCamera et al. | 204/64 |
| 4,115,215 A | | 9/1978 | Das et al. | 204/67 |
| RE30,330 E | | 7/1980 | Das et al. | 204/67 |
| 4,243,502 A | | 1/1981 | Kugler | 204/243 |
| 4,338,177 A | | 7/1982 | Withers et al. | 204/243 |
| 4,342,637 A | | 8/1982 | Withers et al. | 204/282 |
| 4,592,812 A | | 6/1986 | Beck et al. | 204/67 |
| 4,670,110 A | | 6/1987 | Withers et al. | 204/67 |
| 4,865,701 A | | 9/1989 | Beck et al. | 204/67 |
| 4,904,356 A | | 2/1990 | Fray | 204/64 |
| 5,006,209 A | | 4/1991 | Beck et al. | 204/67 |
| 5,284,562 A | | 2/1994 | Beck et al. | 204/243 |
| 5,362,366 A | | 11/1994 | de Nora et al. | 204/67 |
| 5,498,320 A | | 3/1996 | Rendall | 205/205 |
| 6,436,272 B1 | * | 8/2002 | Brown et al. | 205/374 |
| 6,558,525 B1 | * | 5/2003 | Bradford et al. | 205/380 |
| 6,579,438 B1 | * | 6/2003 | Creber et al. | 205/367 |

* cited by examiner

*Primary Examiner*—Donald R. Valentine
(74) *Attorney, Agent, or Firm*—Andrew Alexander

(57) ABSTRACT

An electrolytic cell for producing aluminum from alumina having a reservoir for collecting molten aluminum remote from the electrolysis.

65 Claims, 3 Drawing Sheets

ELECTROLYTIC CELL FOR PRODUCTION OF ALUMINUM FROM ALUMINA

The government has rights in this invention pursuant to Contract No. DE-FC07-98ID13662 awarded by the Department of Energy.

BACKGROUND OF THE INVENTION

This invention relates to aluminum and more particularly it relates to an improved cell for use in the electrolytic production of aluminum from alumina dissolved in a molten salt electrolyte, for example, at low temperatures.

There is great interest in using an inert anode in an electrolytic cell for the production of aluminum from alumina dissolved in the molten salt electrolyte. By definition, the anode should not be reactive with the molten salt electrolyte or oxygen generated at the anode during operation. Anodes of this general type are either comprised of a cermet or metal alloy. For example, U.S. Pat. No. 4,399,008 discloses a composition suitable for fabricating into an inert electrode for use in the electrolytic production of metal from a metal compound dissolved in a molten salt. The electrode comprises at least two metal oxides combined to provide a combination metal oxide.

Also, U.S. Pat. No. 5,284,562 discloses an oxidation resistant, non-consumable anode for use in the electrolytic reduction of alumina to aluminum, which has a composition comprising copper, nickel and iron. The anode is part of an electrolytic reduction cell comprising a vessel having an interior lined with metal which has the same composition as the anode. The electrolyte is preferably composed of a eutectic of $AlF_3$ and either (a) NaF or (b) primarily NaF with some of the NaF replaced by an equivalent molar amount of KF or KF and LiF.

Different processes and electrolytic cell configurations have been suggested for the electrolytic production of aluminum from alumina. For example, U.S. Pat. No. 3,578,580 discloses an apparatus for the electrolysis of molten oxides, especially of alumina, in which the anode is separated from the melt being electrolysed by a layer of oxygen-ion-conducting material, for example cerium oxide stabilized with calcium oxide or other oxides, which is resistant to the melt at the temperature of the electrolysis.

U.S. Pat. No. 4,338,177 discloses a cell for the electrolytic deposition of aluminum at low temperatures and low electrical potential in which the anode is the sole source of aluminum and comprises a composite mixture of an aluminous material such as aluminum oxide and a reducing agent. Conductor means of higher electrical conductivity than the mixture are provided to conduct substantially the entire anodic current to the active anode surface thereby reducing the voltage drop through the highly resistive composite mixture. The mixture may be employed in a self-baking mode or be prebaked. Alternatively, the mixture may be in a particulate form and contained within a porous membrane which passes the electrolyte or other dissolved material while withholding undissolved impurities. The cell may have bipolar electrodes and may be used in combined winning and refining configurations.

U.S. Pat. No. 3,960,678 discloses a process for operating a cell for the electrolysis of a molten charge, in particular aluminum oxide, with one or more anodes, the working surfaces of which are of ceramic oxide material, and anode for carrying out the process. In the process a current density above a minimum value is maintained over the whole anode surface which comes into contact with the molten electrolyte. An anode for carrying out the process is provided at least in the region of the interface between electrolyte and surrounding atmosphere, the three phase zone, with a protective ring of electrically insulating material which is resistant to attack by the electrolyte. The anode may be fitted with a current distributor for attaining a better current distribution.

U.S. Pat. No. 4,110,178 discloses a method and apparatus for producing metal by electrolysis in a molten bath of salt. The apparatus includes an electrolytic cell containing a molten bath of salt and a vertical stack of electrodes located within the bath of salt, with the uppermost electrode being located beneath the upper level of the bath. A baffle extends vertically above the uppermost electrode, the baffle being effective to direct a flow of the bath laterally and beneath the upper level of the bath, and to increase the velocity of the flow of the bath and metal between vertically adjacent electrodes of the vertical stack.

U.S. Pat. No. 4,115,215 discloses a process for purifying aluminum alloys which comprises providing molten aluminum alloy in a container having a porous wall therein capable of containing molten aluminum in the container and being permeable by the molten electrolyte. Aluminum is electrolytically transported through the porous wall to a cathode thereby substantially separating the aluminum from alloying constituents.

U.S. Pat. No. 4,243,502 discloses a wettable cathode for an electrolytic cell for the electrolysis of a molten charge, in particular for the production of aluminum, where the said cathode comprises individual, exchangeable elements each with a component part for the supply of electrical power. The elements are connected electrically, via a supporting element, by molten metal which has separated out in the process. The interpolar distance between the anodes and the vertically movable cathode elements is at most 2 cm.

U.S. Pat. No. 4,342,637 discloses an anode for use in the electrolytic deposition of aluminum at low temperatures in which the anode is the sole source of aluminum and comprises a composite mixture of an aluminous material such as aluminum oxide and a reducing agent such as carbon. Conductor means of higher electrical conductivity than the anodic mixture are provided to conduct substantially the entire anodic current to the active anode surface thereby reducing the voltage drop through the highly resistive composite mixture.

U.S. Pat. No. 4,670,110 discloses a process for the electrolytic deposition of aluminum at low temperatures and at low electrical potential in which the anode is the sole source of aluminum and comprises a composite mixture of an aluminous material such as aluminum oxide and a reducing agent. The composite anode is positioned in the electrolyte with at least one active surface of the anode in opposed relationship to but spaced from the surface of the cathode. The greatly increased electrical resistance of the mixture of aluminum oxide and the reducing agent is minimized by passing the anodic current through one or more conductors of low electrical resistivity which extend through the mixture to or approximately to the active reaction face of the mixture in the electrolyte.

U.S. Pat. No. 4,904,356 discloses a carbon block which acts as a cell electrode. Channels are formed in its face which is to face the cell diaphragm. The channels provide an interconnected network including retention pools arranged to hold, release, break up and mix a liquid stream passing through them.

U.S. Pat. No. 5,362,366 discloses a novel anode-cathode arrangement for the electrowinning of aluminum from alumina dissolved in molten sales, consisting of an anode-cathode double-polar electrode assembly unit or a continuous double polar assembly in which the anode and cathode are bound together and their interelectrode gap is maintained substantially constant by connections made of materials of high electrical, chemical, and mechanical resistance. Novel, multi-double-polar cells for the electrowinning of aluminum contain two or more of such anode-cathode double-polar electrode assembly units. This arrangement permits the removal of reimmersion into any of the anode-cathode double-polar electrode assembly units during operation of the multi-double-polar cell whenever the anode and or the cathode or any part of the electrode unit needs reconditioning for efficient cell operation.

U.S. Pat. No. 5,498,320 discloses a double salt of $KAlSO_4$, as a feedstock which is heated with a eutectic electrolyte, such as $K_2SO_4$, at 800° C. for twenty minutes to produce an out-gas of $SO_3$ and a liquid electrolyte of $K_2SO_4$ with fine-particles of $Al_2O_3$ in suspension having a mean size of six to eight microns. This is pumped into a cell with an electrolyte comprised of $K_2$ $SO_4$ with fine-particles of $Al_2$ $O_3$ in suspension, an anode and a porous cathode of open-cell ceramic foam material. The cell is maintained at 750° C. and four volts of electricity applied between the anode and the cathode causes oxygen to bubble at the anode and liquid aluminum to form in the porous cathode. A channel within the porous cathode, and the porous cathode itself, are deep enough within the cell electrolyte that the pressure head of electrolyte is enough to overcome the difference in density between the molten aluminum and the electrolyte to pump molten aluminum from the channel out of the side of the cell. The electrolyte $K_2$ $SO_4$ is periodically bled-off to control a build-up of the material as aluminum is produced from the double salt of $KAlSO_4$.

In spite of these disclosures, there is still a great need for an electrolytic cell and process for operating the cell that permits efficient electrolytic reduction of alumina to aluminum and removal of molten aluminum without contaminating the aluminum with alumina particles. Further, it is important to remove or drain the molten aluminum from the cathode and collect it in a pool unaffected by turbulence, in the bath or molten electrolyte, created by evolution of gas such as oxygen at the anode. The subject invention solves these problems by efficient removal of molten aluminum.

SUMMARY OF THE INVENTION

It is an object of the present invention to provide an improved method for producing aluminum from alumina in an electrolytic cell.

It is another object of the invention to provide an improved method for producing aluminum from alumina in an electrolytic cell employing inert or unconsumable anodes.

It is another object of the invention to efficiently remove and collect aluminum from the cathode in an electrolytic cell for producing aluminum from alumina.

Yet, it is another object of the invention to remove aluminum from electrolytic cell without contamination with alumina particles, for example.

And yet, it is another object of the invention to remove aluminum from electrolytic cell unaffected by turbulence in the cell created by oxygen evolution at the anode.

These and other objects will become apparent from the specification, claims and drawings appended hereto.

In accordance with these objects, there is provided a method of producing aluminum in an electrolytic cell containing alumina dissolved in an electrolyte, the method comprising providing a molten salt electrolyte at a temperature of less than 900° C. having alumina dissolved therein in an electrolytic cell. The cell comprises a container for containing the electrolyte and for performing electrolysis therein to form aluminum from alumina, the container having a bottom and walls extending upwardly from the bottom. A reservoir is provided in liquid electrolyte communication with the container and contains molten electrolyte, and the bottom of the container contains at least one opening to the reservoir. A plurality of anodes and cathodes is provided in the electrolyte, the cathodes having a bottom end. An electrical current is passed through the anodes and through the electrolyte to the cathodes, depositing aluminum at the cathodes and producing gas at the anodes. Aluminum from the cathode is drained through the opening in the bottom to collect in the reservoir remote from the container where electrolysis is performed. During electrolysis, turbulence results in the molten electrolyte from the evolution of gas at the anodes, and thus it is desirable to remove molten aluminum to a location or reservoir where it is undisturbed. Further, collecting the molten aluminum in a reservoir separate from electrolysis container avoids contamination of the molten aluminum with undissolved alumina which tends to settle out on the bottom of the electrolytic container. In addition, the electrodes are protected from electrical shorting when motion is imparted to the aluminum pad by electromagnetic forces generated in the cell. Removal of metal from the electrolytic reaction zone has another advantage in that it permits closer spacing between the anodes and cathodes. Removal of metal in this way results in more stable cell operation because there is no upset or interference as in conventional cells when metal is removed.

Also provided is an electrolytic cell for producing aluminum from alumina dissolved in an electrolyte, the cell comprised of a vessel for containing the electrolyte and for performing electrolysis therein, the vessel having a bottom and walls extending upwardly from said bottom and means for adding alumina to said vessel to provide alumina-enriched electrolyte. A plurality of anodes and cathodes are disposed in a vertical direction in alternating relationship in the electrolyte contained in the vessel, the cathodes having bottom edges. A reservoir is provided in liquid electrolyte communication with the vessel for collecting molten aluminum therein. The bottom of the vessel containing openings adapted to pass molten aluminum from the cathodes to the reservoir. Means is provided for passing electrical current through the anodes and through the electrolyte to the cathodes for producing aluminum at the cathode and gas at the anodes.

DETAILED DESCRIPTION OF PREFERRED EMBODIMENTS

The subject invention includes an electrolytic cell for the production of aluminum from alumina dissolved in a molten salt electrolyte. Preferably, the molten electrolyte is maintained at a temperature of less than 900° C. However, electrolytes such as cryolite may be used at higher temperatures, e.g., 925° to 975° C. Further, preferably, the alumina is added to the cell on a continuous basis to ensure a controlled supply of alumina during electrolysis. The electrolytic cell of the invention employs anodes and cathodes. In the process of the invention, electric current is passed from the anode through the molten electrolyte to cathode reducing alumina to aluminum and depositing the aluminum at the cathode. While the cathodes are preferably comprised of titanium diboride, it will be understood that the cathodes can be comprised of any suitable material that is substantially inert to the molten aluminum at operating temperatures. Such materials can include zirconium boride, molybdenum, tungsten, titanium carbide and zirconium carbide.

The anode can be any anode but preferably non-consumable anodes selected from cermet or metal alloy anodes substantially inert to electrolyte at operating temperatures. By the use of the terms inert or non-consumable is meant that the anodes are resistant to attack by molten electrolyte and do not react or become consumed in the same manner as carbon anodes in a Hall-Heroult type cell. The cermet is a mixture of metal such as copper and metal oxides or other metal compound. As fabricated, the metal anode is substantially free of metal oxides. A preferred metal, non-consumable anode for use in the cell is comprised of iron, nickel, copper. The metal anode can contain about 1 to 50 wt. % Fe, 15 to 50 wt. % Ni, the remainder comprising copper. A preferred anode consists essentially of 1–30 wt. % Fe, 15–60 wt. % Ni, and 25 to 70 wt. % Cu. Typical non-consumable anodes can have compositions in the range of 2 to 17 wt. % Fe, 25 to 48 wt. % Ni and 45 to 70 wt. % Cu.

The electrolytic cell can have an operating temperature less than 900° C. and typically in the range of 660° C. (1220° F.) to about 800° C. (1472° F.). Typically, the cell can employ electrolytes comprised of $NaF+AlF_3$ eutectics, $KF+AlF_3$ eutectic, and LiF. The electrolyte can contain 6 to 26 wt. % NaF, 7 to 33 wt. % KF, 1 to 6 wt. % LiF and 60 to 65 wt. % $AlF_3$. More broadly, the cell can use electrolytes that contain one or more alkali metal fluorides and at least one metal fluoride, e.g., aluminum fluoride, and use a combination of fluorides as long as such baths or electrolytes operate at less than about 900° C. For example, the electrolyte can comprise NaF and $AlF_3$. That is, the bath can comprise 62 to 53 mol. % NaF and 38 to 47 mol. % $AlF_3$.

Figure 1:
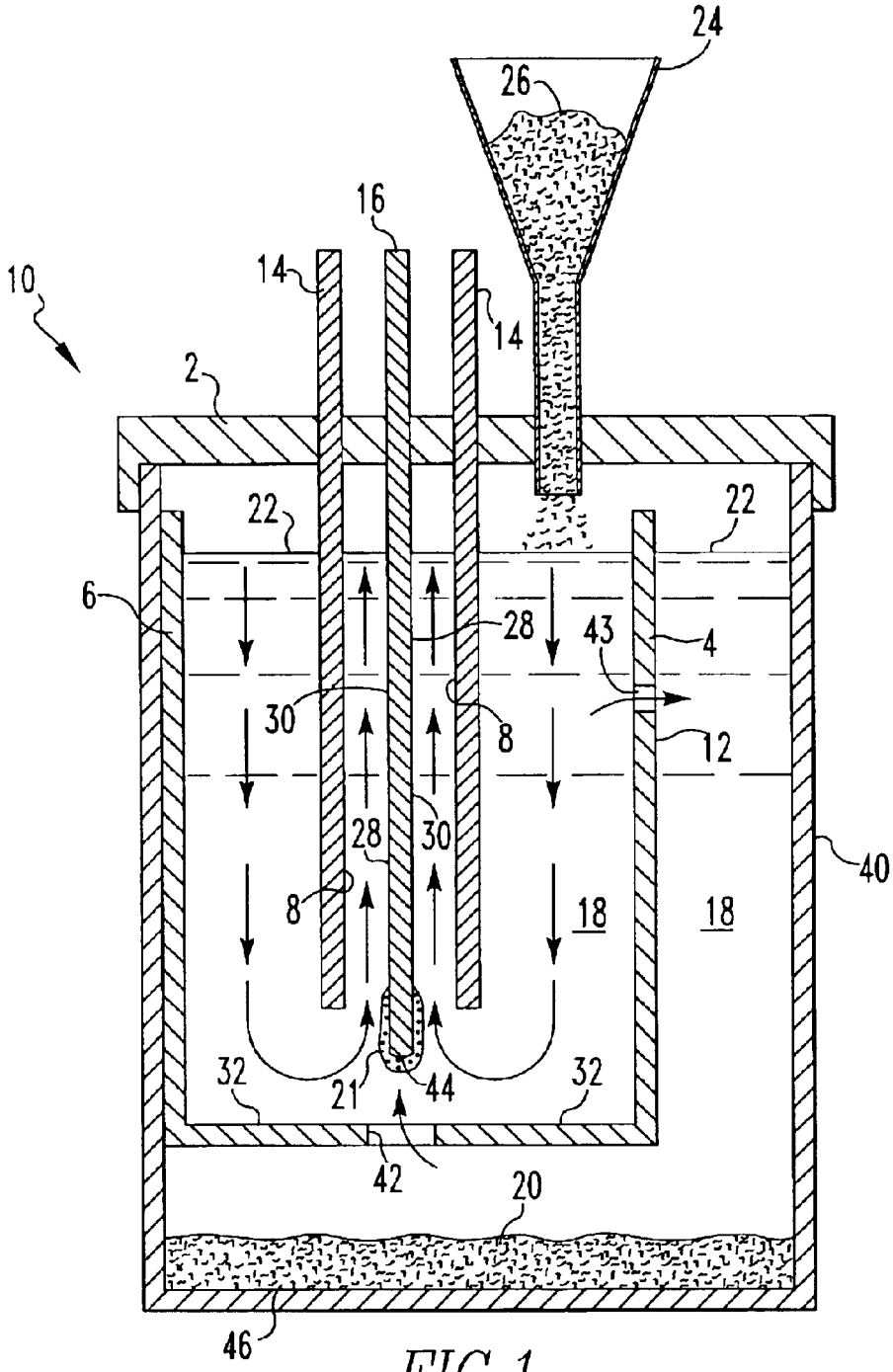
FIG. 1 is a cross-sectional view of an electrolytic cell employed in testing the invention.

Referring now to FIG. 1, there is shown a schematic of a laboratory electrolytic cell 10 used for electrolytically reducing alumina to aluminum, in accordance with the invention. Cell 10 is comprised of an alumina 12 containing anodes 14 of the invention and cathode 16. A molten salt electrolyte 18 also is provided in cell 10. Cell 10 and container 40 are sealed with a cover 2. Anodes 14 and cathode 16 are suspended through lid 2 from a superstructure (not shown) and connected to bus bars above the cell. Anodes 14 and cathode 16 are in the form of vertical plates with an anode on each side of the cathode. The cathode used in the test cell was $TiB_2$ and the anodes were comprised of an Ni—Cu—Fe alloy having 42 wt. % Ni, 30 wt. % Cu, and 28 wt. % Fe. The molten salt electrolyte was comprised of 38.89 wt. % sodium fluoride and 61.11 wt. % aluminum fluoride. For tests, typically the molten electrolyte was maintained below 900° C. and typically in the range of 730° to 800° C. although the temperature can range from 660° to 800° C. for low temperature operation.

Molten salt electrolyte has certain flow patterns within crucible 12 and alumina particles 26 are added to surface 22 of the electrolyte from hopper 24. In the embodiment illustrated in FIG. 1, molten electrolyte is shown flowing in a downward direction adjacent walls 4 and 6 of crucible 12 and in an upwardly direction adjacent cathode surfaces 28 and 30. The lift or upward direction movement of the molten electrolyte is caused in part by the evolution of gases such as oxygen gas at the active anode surface.

In the present invention, there is provided a system for sequestering or segregating molten aluminum produced at the cathode in container 12 to avoid contamination or electrical shorting by molten metal during electrolysis. As noted, during operation of the cell, it is desirable to add alumina 26 from hopper 24 continuously to molten electrolyte 18 to maintain electrolyte 18 close to saturation or above saturation. Maintaining alumina at saturation or above is desirable in order to provide for immediate dissolution of alumina to maintain saturation in the electrolyte and avoid starvation of dissolved alumina at the anode surface. Maintaining saturation is beneficial because it minimizes oxidation and reduction of the anode metal and aids in avoiding consumption of the anode. However, when alumina is maintained at saturation or above saturation, a build-up of undissolved alumina particles can occur inside crucible 12 on or adjacent bottom 32 with the attendant problems of contamination of molten metal collected there during electrolysis. However, it has been discovered that the problems of build-up and contamination can be greatly minimized or avoided if the molten metal is collected and sequestered remote in the molten bath from the electrolysis operation. That is, the sequestered or segregated pool of aluminum is unaffected by the electrolysis operation and bath flow.

In FIG. 1, as noted, there is shown a cross-section of an electrolytic cell 10 and in the embodiment in FIG. 1, it will be noted that crucible 12 of cell 10 is contained in container 40. Also, in the embodiment shown in FIG. 1, lid 2 extends over container 40 to provide a seal over both crucible 12 and container 40.

In FIG. 1, it will be seen that crucible 12 is provided with an opening or channel 42 in bottom 32. Further, in FIG. 1, opening 42 in bottom 32 is positioned under bottom edge 44 of cathode 16. It will be understood that opening 42 permits molten electrolyte to enter container 40 and thus in the embodiment shown in FIG. 1, molten electrolyte has the same surface height 22 in crucible 12 and container 40. Opening or passageway 42 has another important function in that during electrolysis it permits aluminum 21 accumulated on cathode 16, particularly cathode bottom 44, to flow or drain into container 40 and accumulate as a layer 20 on bottom or floor 46. Thus, layer 20 is accumulated and separately confined remote from electrolysis in crucible 12 and from disturbance by bath flow patterns or magnetic forces. Further, molten metal layer 20 is substantially free from contamination by particles of alumina which may build up on crucible bottom 32. In addition, the cell is not subject to electrical shorting by molten metal movement. However, it should be noted that a small amount of flow of electrolyte may occur between reservoir 40 and crucible 12 but is not detrimental.

Flow of electrolyte can be controlled upwardly through passageway 42. That is, a pressure equalization opening 43 may be provided in wall 4 of crucible 12 below electrolyte surface 22. In the embodiment shown in FIG. 1, opening 43 permits electrolyte to flow therethrough and surface level in each container remains substantially the same. Further, with opening 43, electrolyte tends to flow or circulate upwardly through opening 42 and then outwardly through opening 43.

Molten aluminum layer 20 may be removed by siphoning or tapping from container 40. For example, a siphon tube (not shown) may be inserted through lid 2 through electrolyte 18 outside crucible 12 and into metal layer 20 and molten metal removed in this manner.

Figure 2:
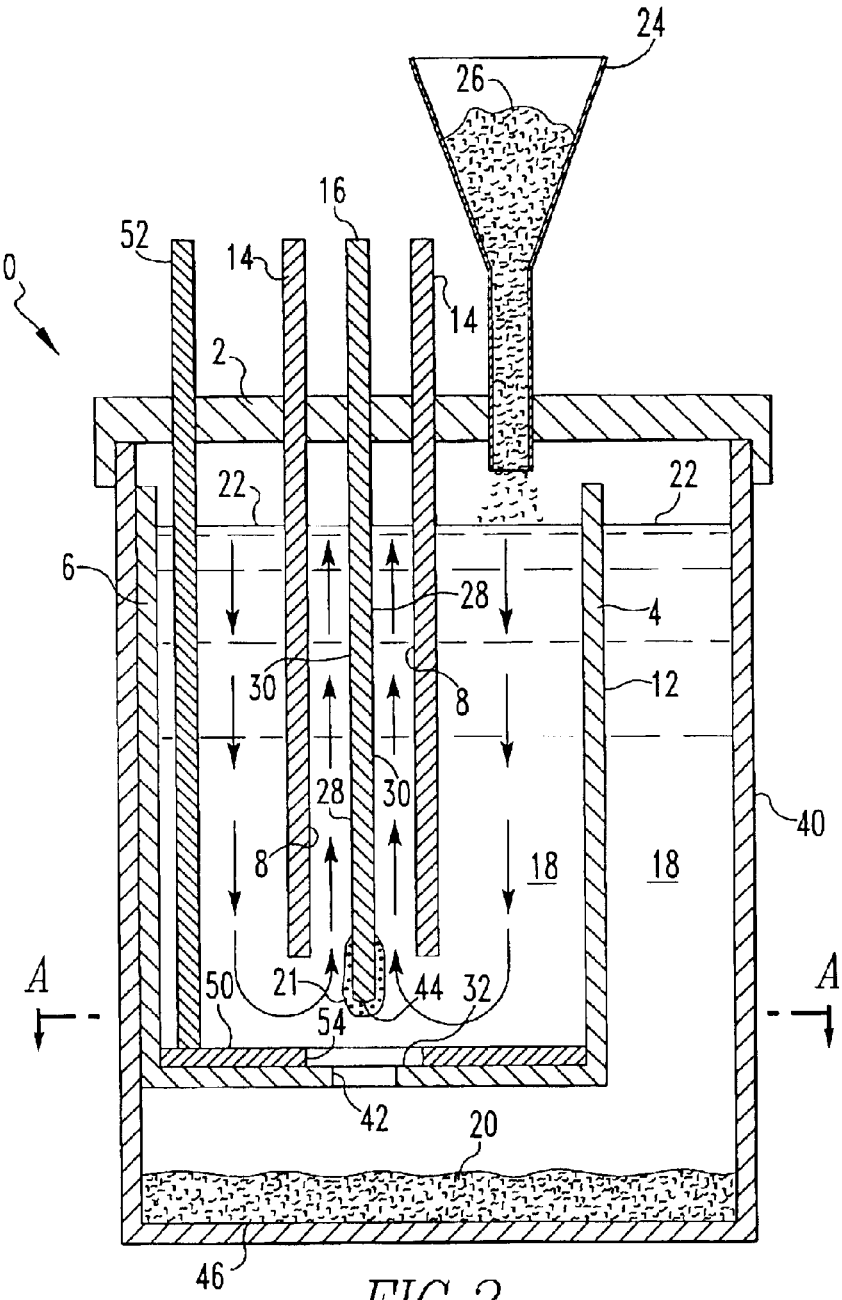
FIG. 2 is a cross-sectional view of an electrolytic cell showing a bottom anode.

In FIG. 2, it will be seen that in the embodiment shown, crucible 12 of cell 10 is provided with a bottom anode 50 which covers bottom 32 of crucible 12. Electric current is transferred to bottom anode 50 along conductor 52. Bottom anode 50 is provided with opening 54 to permit molten aluminum 21 to pass from cathode 16 to molten aluminum layer 20. Anode 50 may be energized from the same current source as anodes 14 and provides for additional anode surface area during electrolysis. In an alternate embodiment, crucible 12 may be fabricated from anode metal and energized as an anode instead of the bottom anode plate. Anode 50 or crucible 12, when acting an as an anode, provides the additional benefit of evolving oxygen gas during electrolysis and prevents or minimizes alumina particles from settling out on bottom 32 of crucible 12, particularly when alumina is present in the electrolyte at greater than saturation, e.g., 6 to 30 wt. %. While anode 50 is shown having apertures or opening 54 therein, solid anodes may be employed but separated to provide openings for molten metal to pass through to accumulate in layer 20.

Figure 3:
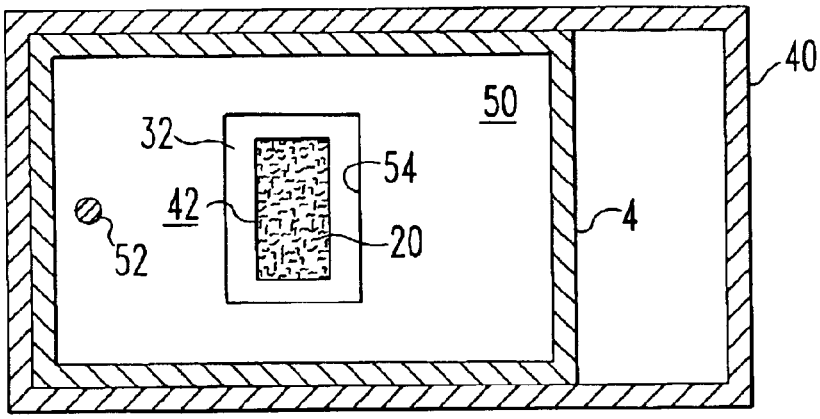
FIG. 3 is a cross-sectional view along the line A—A of FIG. 2.
Figure 4:
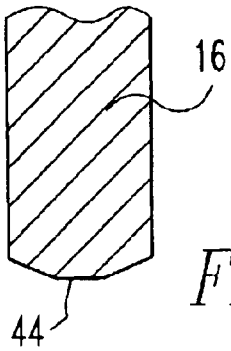
FIG. 4 is a partial side view of a cathode showing the bottom end of the cathode.

From FIG. 3, which is a cross-sectional view along the line A—A of FIG. 2, it will be seen that opening 42 through bottom 32 and opening 54 through bottom anode 50 can be rectangular to accommodate the shape of end or bottom edge 44 of cathode 16. However, other shapes such as circular can be used, depending on the configuration of end 44 of cathode 16. For example, end 44 can be tapered to facilitate or collect molten aluminum deposited on the cathode. FIG. 4 shows a side view of cathode 16 and bottom end 44 which promotes collection of aluminum at end 44.

Alumina useful in the cell can be any alumina that is comprised of finely divided particles. Usually, the alumina has a particle size in the range of about 1 to 100 $\mu$m.

In the present invention, the cell can be operated at a current density in the range of 0.1 to 1.5 A/cm$^2$ while the electrolyte is maintained at a temperature in the range of 660° to 800° C. A preferred current density is in the range of about 0.4 to 1.3 A/cm$^2$. The lower melting point of the bath (compared to the Hall cell bath which is above 950° C.) permits the use of lower cell temperatures, e.g., 730° to 800° C. and reduces corrosion of the anodes and cathodes.

The anodes and cathodes in the cell can be spaced to provide an anode-cathode distance in the range of ¼ to 1 inch. That is, the anode-cathode distance is the distance between anode surface 8 and cathode surface 28 or 30.

Further, in a commercial cell thermal insulation can be provided around liner or crucible 12 and on the lid in an amount sufficient to ensure that the cell can be operated without a frozen crust and frozen side walls. However, in certain instances, it may be desirable to permit freezing of bath on the sidewalls to provide for sidewall protection.

The following example is still further illustrative of the invention.

EXAMPLE

This invention was tested in a 100Å cell having the configuration shown in FIG. 1 with alumina added to the cell substantially continuously. The cell comprised an alumina ceramic crucible. The crucible was placed inside a larger alumina ceramic container as shown in FIG. 1. Within the ceramic crucible was placed a vertical cathode suspended through the lid of the container and connected to a bus bar. The bottom of the crucible was provided with a circular opening disposed opposite the bottom of the cathode drain tip to permit molten aluminum from the cathode to pass through and collect on the floor of the larger container. On either side of the cathode, two anodes were positioned or suspended through the lid and connected to bus bar. The anodes were 3½ inches wide by 2½ inches high by ¼ inch thick. The anodes were comprised of 42 wt. % Cu, 30 wt. % Ni and 28 wt. % Fe, and the cathode was $TiB_2$. The cell contained a molten salt bath comprised of 38.89 wt. % sodium fluoride and 61.11 wt. % aluminum fluoride. The crucible and larger container were sealed with an insulating lid and the cell was maintained at an operating temperature of 770°–780° C. which was above the melting point of the salt bath and the aluminum metal. The alumina fed to the crucible had a particle size of about 100 $\mu$m or less and was effectively ingested by the circulation of the bath in the cell during operation. The cell was operated at a current density of up to 1 amp/cm$^2$. Oxygen gas evolved at the active face of the anode provided a generally upward movement of the bath in the regions between the anode and the cathode. The bath had a generally downward movement between the anodes and the wall of the crucible. Oxygen was removed from the cell through the alumina feed tube. Aluminum deposited at the cathode drained through the opening in the bottom of the crucible and collected on the floor of the larger container remote from the turbulence of the bath. The anodes were used for about 100 hours without any appearance of blistering or significant corrosion. The cell was also operated at the same current with a bottom anode and circular hole 54 as shown in FIG. 2. The same two side anodes previously described were re-used for an additional 100 hours in this second operation.

Having described the presently preferred embodiments, it is to be understood that the invention may be otherwise embodied within the scope of the appended claims.

What is claimed is:

1. A method of producing aluminum in an electrolytic cell containing alumina dissolved in an electrolyte, the method comprising the steps of:

(a) providing a molten salt electrolyte at a temperature of less than 900° C. having alumina dissolved therein in an electrolytic cell, said cell comprising:

(i) a container for containing the electrolyte and for performing electrolysis therein to form aluminum from alumina, said container having a bottom and walls extending upwardly from said bottom; and (ii) a reservoir in liquid electrolyte communication with said container and containing molten electrolyte, said bottom containing at least one opening to said reservoir;

(b) providing substantially non-consumable anodes and cathodes in said electrolyte, said cathodes having a bottom end;

(c) passing electrical current through said anodes and through said electrolyte to said cathodes, depositing aluminum at said cathodes and producing gas at said anodes; and (d) removing aluminum from said cathode through said opening in said bottom to collect said aluminum deposited on said cathode in said reservoir remote from said electrolysis.

2. The method in accordance with claim 1 wherein said cathodes and said anodes have planar surfaces.

3. The method in accordance with claim 1 wherein said electrolyte is comprised of one or more alkali metal fluorides.

4. The method in accordance with claim 1 wherein said electrolyte is comprised of one or more alkali metal fluorides and aluminum fluoride.

5. The method in accordance with claim 1 including maintaining said electrolyte in a temperature range of about 660° to 800° C.

6. The method in accordance with claim 1 wherein said electrolyte has a melting point in the range of 715° to 800° C.

7. The method in accordance with claim 1 including passing an electric current through said cell at a current density in the range of 0.1 to 1.5 A/cm$^2$.

8. The method in accordance with claim 1 including maintaining said container as an anode by passing electric current therethrough.

9. The method in accordance with claim 1 wherein said anodes are selected from the group consisting of cermets and metal alloys.

10. The method in accordance with claim 1 wherein said anodes are comprised of metal alloys.

11. The method in accordance with claim 10 wherein said anodes are comprised of a NiCuFe-containing alloy.

12. The method in accordance with claim 1 wherein said cathodes are selected from the group consisting of titanium diboride, zirconium diboride, titanium carbide, zirconium carbide and molybdenum.

13. The method in accordance with claim 1 wherein said anodes and cathodes have planar surfaces arranged in a vertical orientation in said electrolyte and wherein said anodes and cathodes are arranged in alternating relationship.

14. The method in accordance with claim 1 including adding alumina to said cell on a substantially continuous basis.

15. The method in accordance with claim 1 wherein said anode is a cermet anode.

16. The method in accordance with claim 1 wherein said opening in said bottom is located substantially opposite said cathode bottom end to permit molten aluminum from said cathode to pass into said reservoir.

17. The method in accordance with claim 1 wherein said flow of molten electrolyte in said cell is generally in an upwardly direction between said anodes and said cathodes.

18. The method in accordance with claim 1 including maintaining alumina in said electrolyte in a range of 3.2 to 4.5 wt. %.

19. The method in accordance with claim 1 wherein said cell employs a bottom anode inside said cell positioned adjacent said bottom, said bottom anode adapted to permit molten aluminum to pass from the cathode to said reservoir.

20. The method in accordance with claim 1 including making said bottom anodic by passing electric current therethrough.

21. A method of producing aluminum in an electrolytic cell containing alumina dissolved in an electrolyte, the method comprising the steps of:

(a) providing a molten salt electrolyte having a melting point in the range of 715° to 800° C. and having alumina dissolved therein in an electrolytic cell comprising:

(i) a container for containing the electrolyte and for performing electrolysis therein to recover aluminum from alumina, said container having a bottom and walls extending upwardly from said bottom; and (ii) a reservoir in liquid electrolyte communication with said container and containing molten electrolyte, said bottom containing at least one opening to said reservoir;

(b) providing a plurality of anodes and cathodes disposed in a generally vertical direction in said electrolyte, said cathodes having a planar surface disposed opposite an anode planar surface, said cathodes' and said anodes' planar surfaces defining a region therebetween, said anodes comprised of a material selected from the group consisting of cermet and metal alloy;

(c) passing electrical current through said anodes and through said electrolyte to said cathodes, depositing aluminum at said cathodes and producing gas at said anodes; and (d) removing aluminum from said cathodes through said opening in said bottom to collect said aluminum deposited on said cathodes in said reservoir remote from said electrolysis.

22. The method in accordance with claim 21 wherein said electrolyte is comprised of one or more alkali metal fluorides.

23. The method in accordance with claim 21 wherein said electrolyte is comprised of one or more alkali metal fluorides and aluminum fluoride.

24. The method in accordance with claim 21 including maintaining said container as an anode by passing electric current therethrough.

25. The method in accordance with claim 21 including passing an electric current through said cell at a current density in the range of 0.1 to 1.5 A/cm$^2$.

26. The method in accordance with claim 21 wherein said anodes are comprised of metal alloys.

27. The method in accordance with claim 21 wherein said anodes are comprised of a NiCuFe-containing alloy.

28. The method in accordance with claim 21 wherein said anodes and cathodes have planar surfaces and wherein said anodes and cathodes are arranged in alternating relationship.

29. The method in accordance with claim 21 including adding alumina to said cell on a substantially continuous basis.

30. The method in accordance with claim 21 wherein said anode is a cermet anode.

31. The method in accordance with claim 21 wherein said container employs a bottom anode, said bottom anode adapted to permit molten aluminum to pass from the cathode to said reservoir.

32. The method in accordance with claim 21 including making said bottom anodic by passing electric current therethrough.

33. A method of producing aluminum in an electrolytic cell containing alumina dissolved in an electrolyte, the method comprising the steps of:

(a) providing a molten salt electrolyte having alumina dissolved therein in an electrolytic cell comprising:

(i) a container for containing the electrolyte and for performing electrolysis therein to form aluminum from alumina, said container having a bottom and walls extending upwardly from said bottom; and (ii) a reservoir in liquid electrolyte communication with said container and containing molten electrolyte, said bottom containing at least one opening to said reservoir;

(b) adding alumina to said electrolyte on a continuous basis to provide an alumina-enriched electrolyte;

(c) providing a plurality of substantially non-consumable anodes and cathodes disposed in a generally vertical direction in said electrolyte, said cathodes having a bottom edge positioned above said opening, said cathodes and said anodes defining a region therebetween;

(d) flowing alumina-enriched electrolyte to said region between said anodes and said cathodes;

(e) passing electrical current through said anodes and through said electrolyte to said cathodes, depositing aluminum at said cathodes and producing gas at said anodes, thereby creating turbulence in said container; and (f) removing aluminum from said cathodes through said opening in said bottom to collect said aluminum deposited on said cathodes in said reservoir remote from said electrolysis.

34. The method in accordance with claim 33 including maintaining alumina in said electrolyte at not greater than 0.5 wt. % above saturation.

35. The method in accordance with claim 33 wherein said flow of molten electrolyte in said cell is generally in an upwardly direction in the region between said cathodes and said anodes.

36. The method in accordance with claim 33 wherein said electrolyte is comprised of one or more alkali metal fluorides.

37. The method in accordance with claim 33 wherein said electrolyte is comprised of one or more alkali metal fluorides and aluminum fluoride.

38. The method in accordance with claim 33 including maintaining said electrolyte in a temperature range of about 660° to 800° C.

39. The method in accordance with claim 33 wherein said electrolyte has a melting point in the range of 715° to 800° C. and an alumina solubility limit in the range of about 3.2 to 5 wt. %.

40. The method in accordance with claim 33 including passing an electric current through said cell at a current density in the range of 0.1 to 1.5 A/cm$^2$.

41. The method in accordance with claim 33 including maintaining said container as an anode by passing electric current therethrough.

42. The method in accordance with claim 33 wherein said anodes are comprised of a NiCuFe-containing alloy.

43. The method in accordance with claim 33 wherein said cathodes are selected from the group consisting of titanium diboride, zirconium diboride, titanium carbide, zirconium carbide and molybdenum.

44. The method in accordance with claim 33 including providing planer anodes and cathodes in said electrolyte and arranging said anodes and cathodes in alternating relationship.

45. The method in accordance with claim 33 including adding said alumina at a rate sufficient to maintain alumina at least at saturation in the molten electrolyte.

46. In an improved method of producing aluminum in an electrolytic cell containing alumina dissolved in an electrolyte wherein a molten salt electrolyte is maintained at a temperature of less than 900° C., the electrolyte having alumina dissolved therein, and alumina added to the electrolyte on a continuous basis to provide alumina-enriched electrolyte, and wherein a plurality of non-consumable anodes and cathodes are disposed in a vertical direction in said electrolyte, said cathodes having bottom edges, the improved method comprising:

(a) providing a container for containing the electrolyte and for performing electrolysis therein to form aluminum from alumina, said container having a bottom and walls extending upwardly from said bottom;

(b) providing a reservoir below said container in liquid electrolyte communication with said container and containing molten electrolyte, said bottom containing openings to said reservoir disposed below said cathode bottom edges to permit molten aluminum from said cathodes to pass into said reservoir;

(c) passing electrical current through said anodes and through said electrolyte to said cathodes, depositing aluminum at said cathodes and producing gas at said anodes; and (d) passing aluminum from said cathode through said openings in said bottom to collect aluminum in said reservoir remote from said electrolysis.

47. The method in accordance with claim 46 wherein said electrolyte is comprised of one or more alkali metal fluorides.

48. The method in accordance with claim 46 wherein said electrolyte is comprised of one or more alkali metal fluorides and aluminum fluoride.

49. The method in accordance with claim 46 including maintaining said electrolyte in a temperature range of about 660° to 800° C.

50. The method in accordance with claim 46 wherein said electrolyte has a melting point in the range of 715° to 800° C.

51. The method in accordance with claim 46 including passing an electric current through said cell at a current density in the range of 0.1 to 1.5 A/cm$^2$.

52. The method in accordance with claim 46 including maintaining said container as an anode by passing electric current therethrough.

53. The method in accordance with claim 46 wherein said anodes are selected from the group consisting of cermets and metal alloys.

54. The method in accordance with claim 46 wherein said anodes are comprised of metal alloys.

55. The method in accordance with claim 54 wherein said anodes are comprised of a NiCuFe-containing alloy.

56. The method in accordance with claim 55 wherein said cathodes are selected from the group consisting of titanium diboride, zirconium diboride, titanium carbide, zirconium carbide and molybdenum.

57. The method in accordance with claim 46 wherein said cell employs a bottom anode adapted to permit molten metal to pass from the cathode to said reservoir.

58. The method in accordance with claim 46 including making said bottom anodic by passing electric current therethrough.

59. An electrolytic cell for producing aluminum from alumina dissolved in an electrolyte, the cell comprised of:

(a) a vessel for containing the electrolyte and for performing electrolysis therein, the vessel having a bottom and walls extending upwardly from said bottom and means for adding alumina to said vessel to provide alumina-enriched electrolyte;

(b) a plurality of non-consumable anodes and cathodes disposed in a vertical direction in alternating relationship in said electrolyte contained in said vessel, said cathodes having a bottom edge; and (c) a reservoir in liquid electrolyte communication with said vessel for collecting molten aluminum therein, said bottom of said vessel containing openings adapted to pass molten aluminum from said cathodes to said reservoir;

(d) means for passing electrical current through said anodes and through said electrolyte to said cathodes for producing aluminum at said cathode and gas at said anodes.

60. The cell in accordance with claim 59 wherein said cathode surface is a planar surface.

61. The cell in accordance with claim 59 wherein said anode surface is a planar surface.

62. The cell in accordance with claim 59 wherein the anodes are comprised of material selected from the group consisting of cermets and metal alloys.

63. The cell in accordance with claim 59 wherein the anodes are comprised of Ni—Cu—Fe alloy.

64. The cell in accordance with claim 59 wherein the cathodes are selected from the group consisting of titanium diboride, zirconium diboride, titanium carbide, zirconium carbide and molybdenum.

65. The cell in accordance with claim 59 wherein said cell is arranged to permit flow of molten electrolyte in said cell is generally in an upwardly direction between said anodes and said cathodes.

* * * * *